US006196373B1

(12) United States Patent
Rizzoli et al.

(10) Patent No.: US 6,196,373 B1
(45) Date of Patent: Mar. 6, 2001

(54) DEVICE FOR TRANSFERRING CIGARETTE PORTIONS

(75) Inventors: Salvatore Rizzoli, Bologna; Fiorenzo Draghetti, Medicina, both of (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 09/129,568

(22) Filed: Aug. 5, 1998

(30) Foreign Application Priority Data

Aug. 6, 1997 (IT) ..... BO97A0497

(51) Int. Cl.[7] ..... B65G 47/22
(52) U.S. Cl. ..... 198/475.1
(58) Field of Search ..... 198/475.1, 433, 198/471.1

(56) References Cited

U.S. PATENT DOCUMENTS

| | | | | |
|---|---|---|---|---|
| 3,303,926 | * | 2/1967 | Pohl | 198/475.1 |
| 3,567,011 | * | 3/1971 | Pinkham | 198/475.1 |
| 4,051,947 | * | 10/1977 | Schumacher et al. | 198/475.1 |
| 4,244,250 | * | 1/1981 | Rudszinat | 198/480 |
| 4,380,283 | * | 4/1983 | Van Maanen | 198/475.1 |
| 4,574,818 | * | 3/1986 | Pagnoni | 198/475.1 |
| 4,645,063 | * | 2/1987 | Seragnoli | 198/475.1 |
| 4,804,079 | * | 2/1989 | Hensgen et al. | 198/475.1 |
| 4,827,948 | * | 5/1989 | Schumacher | 198/471.1 |
| 5,255,777 | * | 10/1993 | Pawelko | 198/471.1 |
| 5,322,157 | * | 6/1994 | Dahlgrun | 198/475.1 |
| 5,327,803 | * | 7/1994 | DeMay, III | 198/475.1 |

FOREIGN PATENT DOCUMENTS

| | | | |
|---|---|---|---|
| 3641064 | | 6/1988 | (DE) . |
| 4203517 | | 8/1992 | (DE) . |
| 2406399 | | 5/1979 | (FR) . |
| 2516901 | | 5/1983 | (FR) . |
| 2259289 | | 3/1993 | (GB) . |
| 61-178323 | * | 8/1986 | (JP) ..... 198/475.1 |

* cited by examiner

*Primary Examiner*—Douglas Hess
(74) *Attorney, Agent, or Firm*—Marshall, O'Toole, Gerstein, Murray & Borun

(57) ABSTRACT

A cigarette portion is transferred from a bed of a manufacturing machine to a respective first seat of a supply unit for supplying an input conveyor of a filter-assembly machine by a pickup member having a second seat for receiving and retaining the cigarette portion and movable along an annular path tangent to the bed and to the supply unit; the orientation of the second seat being controlled, as the second seat travels along the annular path, by two guide members hinged to two portions of the pickup member separated by a given distance from each other to generate a control moment by which to keep the second seat parallel to itself along the annular path.

6 Claims, 5 Drawing Sheets

DEVICE FOR TRANSFERRING CIGARETTE PORTIONS

BACKGROUND OF THE INVENTION

The present invention relates to a device for transferring cigarette portions.

More specifically, the present invention relates to a device for transferring quadruple cigarette portions, i.e. portions four times the length of the tobacco-filled portion of a finished filter-tipped cigarette, from a manufacturing machine to a filter-assembly machine.

One known method used in the tobacco industry to produce filter-tipped cigarettes comprises forming, on a manufacturing machine, a continuous cigarette rod of tobacco enclosed in a tubular wrapping; cutting double cigarette portions off the cigarette rod, i.e. portions twice the length of the tobacco-filled portion of a finished filter-tipped cigarette; and transferring the double cigarette portions from the manufacturing machine to respective seats on the input conveyor of a filter-assembly machine to connect the filters.

The double cigarette portions are normally transferred using a transfer device comprising a pickup unit for picking the cigarette portions up off the bed of the manufacturing machine; and a supply unit for receiving the cigarette portions from the pickup unit and feeding the cigarette portions, parallel to themselves, to the input conveyor of the filter-assembly machine.

The pickup unit comprises a drum rotating about a respective axis and supporting a number of arms, which are connected to the drum so as to rotate, with respect to the drum, about respective first axes parallel to the axis of the drum, and are each fitted at the free end with a pickup member, which rotates, with respect to the respective arm, about a second axis parallel to the axis of the drum.

Each pickup member comprises an elongated seat with suction holes for retaining a cigarette portion inside the seat, and, in the case of a transfer device used in conjunction with a dual-rod cigarette manufacturing machine, comprises a pair of parallel seats with suction holes for simultaneously receiving a pair of parallel cigarette portions.

The arras are connected to the drum by a first gear transmission for so orienting the arms that the pickup members travel along a substantially elliptical annular path; and the pickup members are connected to the respective arms by a second gear transmission powered by the first transmission and which provides for so orienting the pickup members, with respect to the respective arms, as to keep the pickup members parallel to themselves along said annular path.

The transfer device described advances the pickup members of the pickup unit parallel to the traveling direction of the cigarette portions on the manufacturing machine bed, and along said annular path, which extends about the axis of the drum and is tangent to both the machine bed at a pickup station, and to the outer periphery of at least one roller of the supply unit.

Though used to advantage for transferring cigarette portions between a manufacturing machine and respective filter-assembly machine, the above transfer device involves several drawbacks due to inevitable slack between the gears of said transmissions causing each pickup member to oscillate slightly about the respective axis, thus resulting in misalignment of the respective seat with respect to the respective cigarette portion on the manufacturing machine bed, and in even greater misalignment of the picked-up cigarette portion with respect to the respective seat on the supply unit roller; which misalignments create problems both when picking up and releasing the cigarette portions.

The above drawbacks are further compounded when the device is used for transferring portions longer than double cigarette portions, and in particular for transferring quadruple cigarette portions, which call for longer seats than those normally used for transferring double cigarette portions. That is, for a given degree of oscillation of the pickup members about their respective axes, the above misalignments are proportional to the length of the seats during pickup, and to the length of the cigarette portions during release.

SUMMARY OF THE INVENTION

It is an object of the present invention to provide a device for transferring cigarette portions, designed to eliminate the aforementioned drawbacks.

According to the present invention, there is provided a device for transferring cigarette portions between a pickup station, located along a bed of a cigarette manufacturing machine, and at least a first seat of a supply unit for supplying the cigarette portions to an input conveyor of a filter-assembly machine; the transfer device comprising a pickup member having a second seat for receiving and retaining a cigarette portion and movable along an annular path tangent to the bed and to the supply unit; and guide means connected to the pickup member to move the pickup member along said path and control the orientation of the second seat as the second seat travels along said path; characterized in that said guide means comprise a first guide unit and a second guide unit hinged to respective portions of the pickup member separated from each other by a given distance so as to generate a control moment to keep the second seat parallel to itself along the annular path.

Supporting two distinct portions of the pickup member therefore prevents any oscillation of the pickup member with respect to the first and the second seat.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
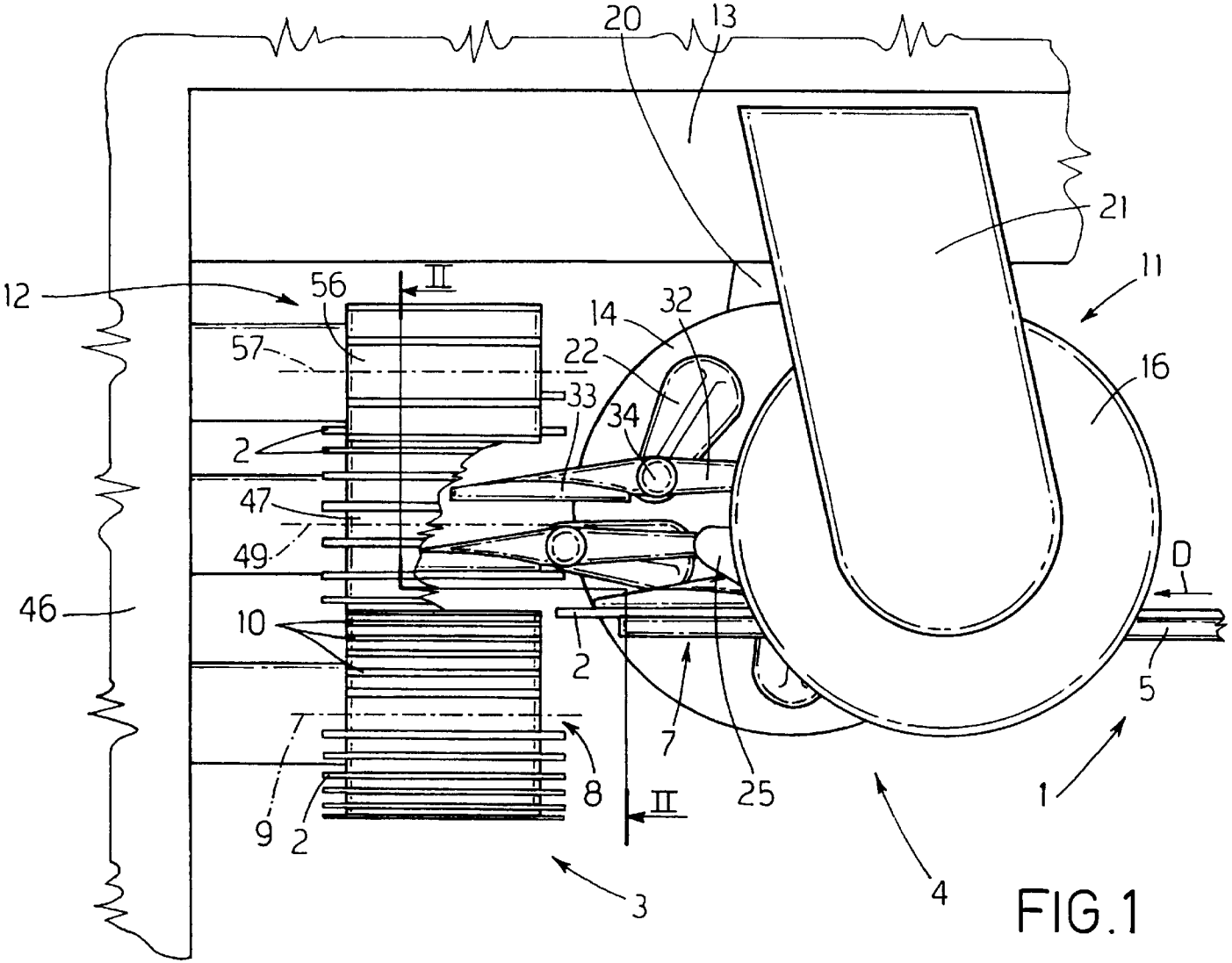
FIG. 1 shows a side view, with parts removed for clarity, of a preferred embodiment of the device according to the invention.
Figure 2:
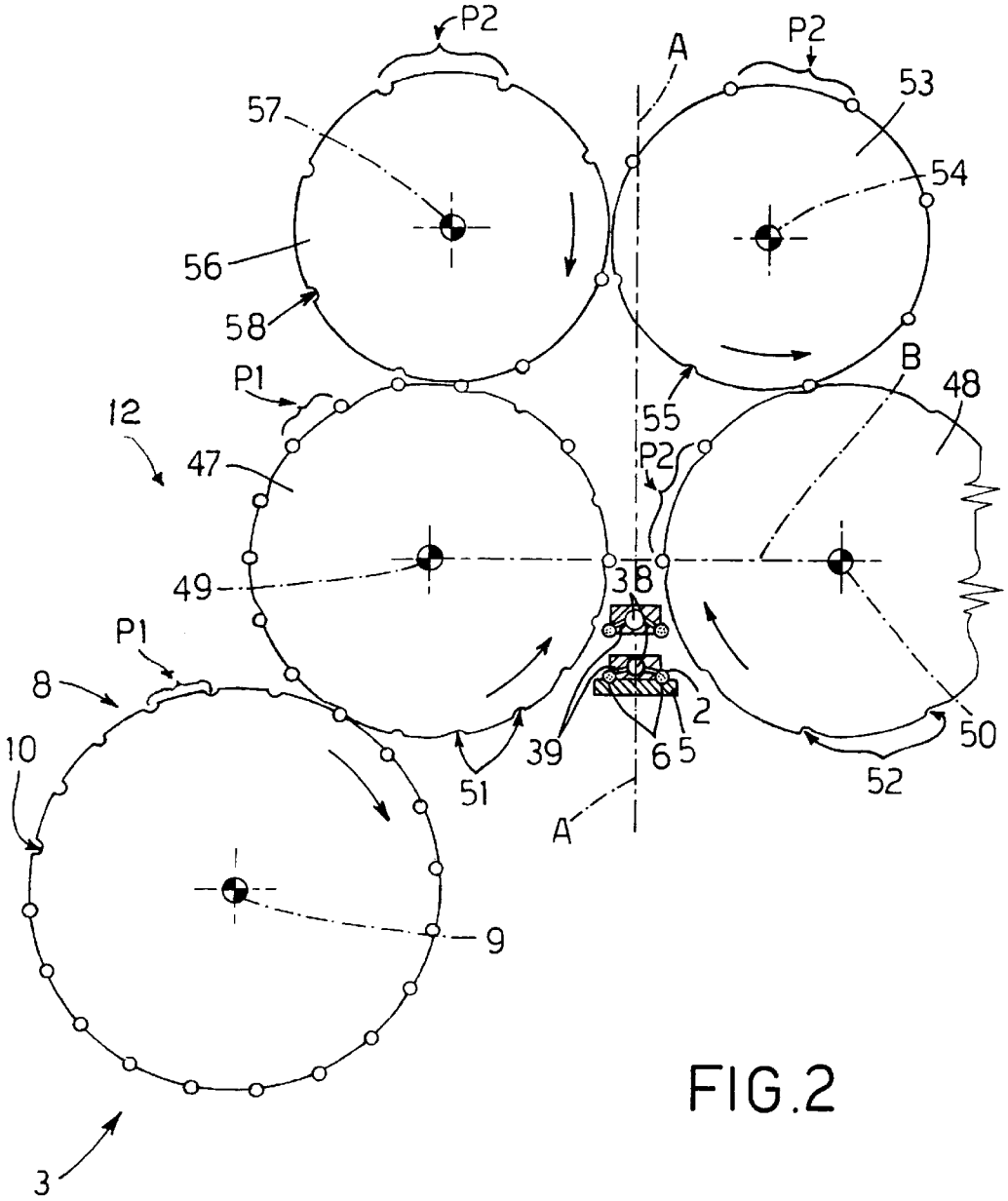
FIG. 2 shows a section, with parts removed for clarity, along line II—II in FIG. 1.
Figure 3:
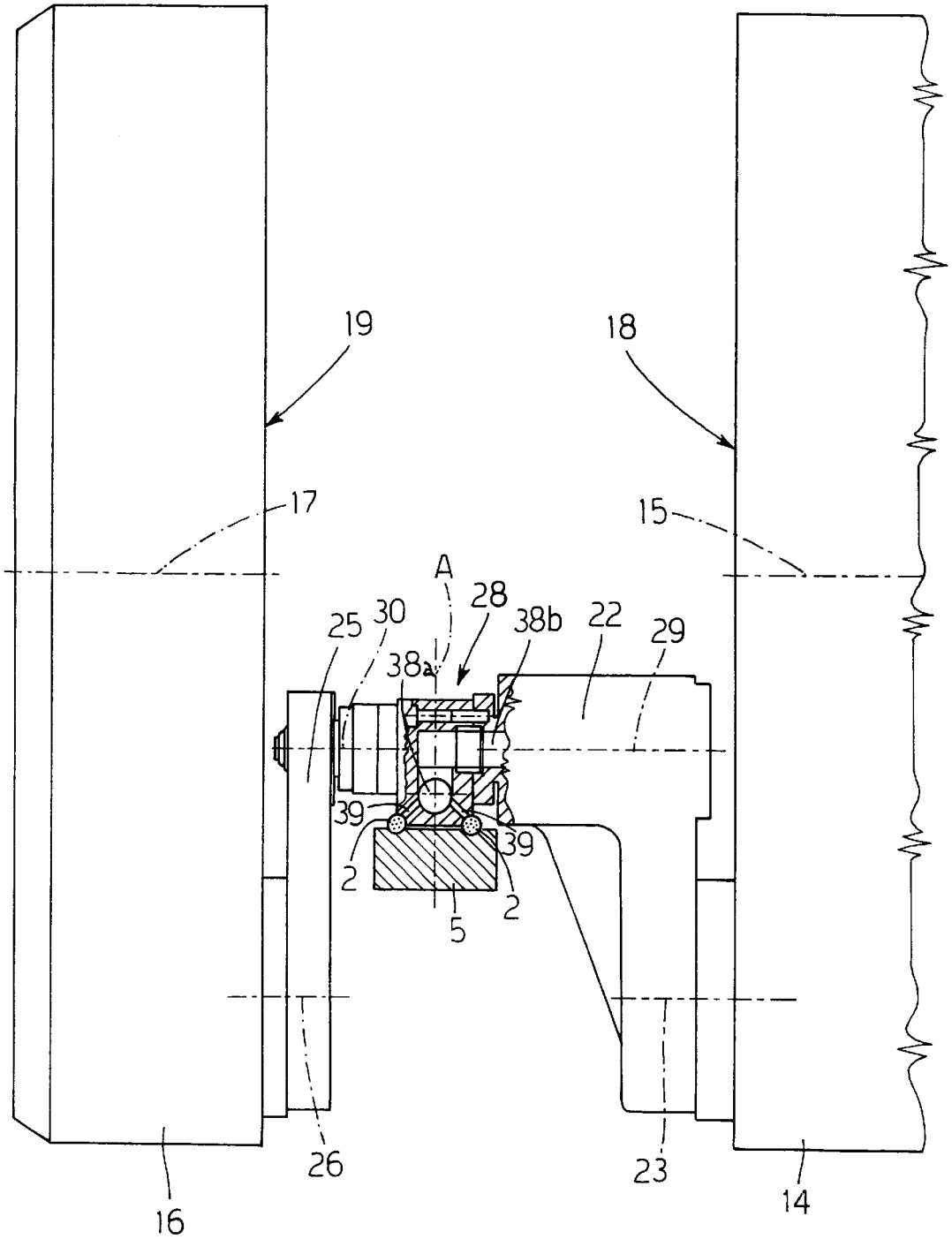
FIG. 3 shows a larger-scale partial section of a detail in FIG. 1.

With reference to FIGS. 1, 2 and 3, number 1 indicates as a whole a dual-rod cigarette manufacturing machine for producing cigarette portions 2, which are transferred to a filter-assembly machine 3 by means of a transfer device 4.

Manufacturing machine 1 comprises a bed 5, along which extend two parallel guides 6 located on opposite sides of the plane of symmetry A of bed 5, and for feeding pairs of cigarette portions 2 in a traveling direction D to a pickup station 7.

Filter-assembly machine 3 comprises a drum type input conveyor 8 rotating about a respective axis 9 parallel to direction D, and having seats 10, which are equally spaced with a spacing P1 about axis 9, are parallel to axis 9, and provide for receiving respective cigarette portions 2.

Figure 5:
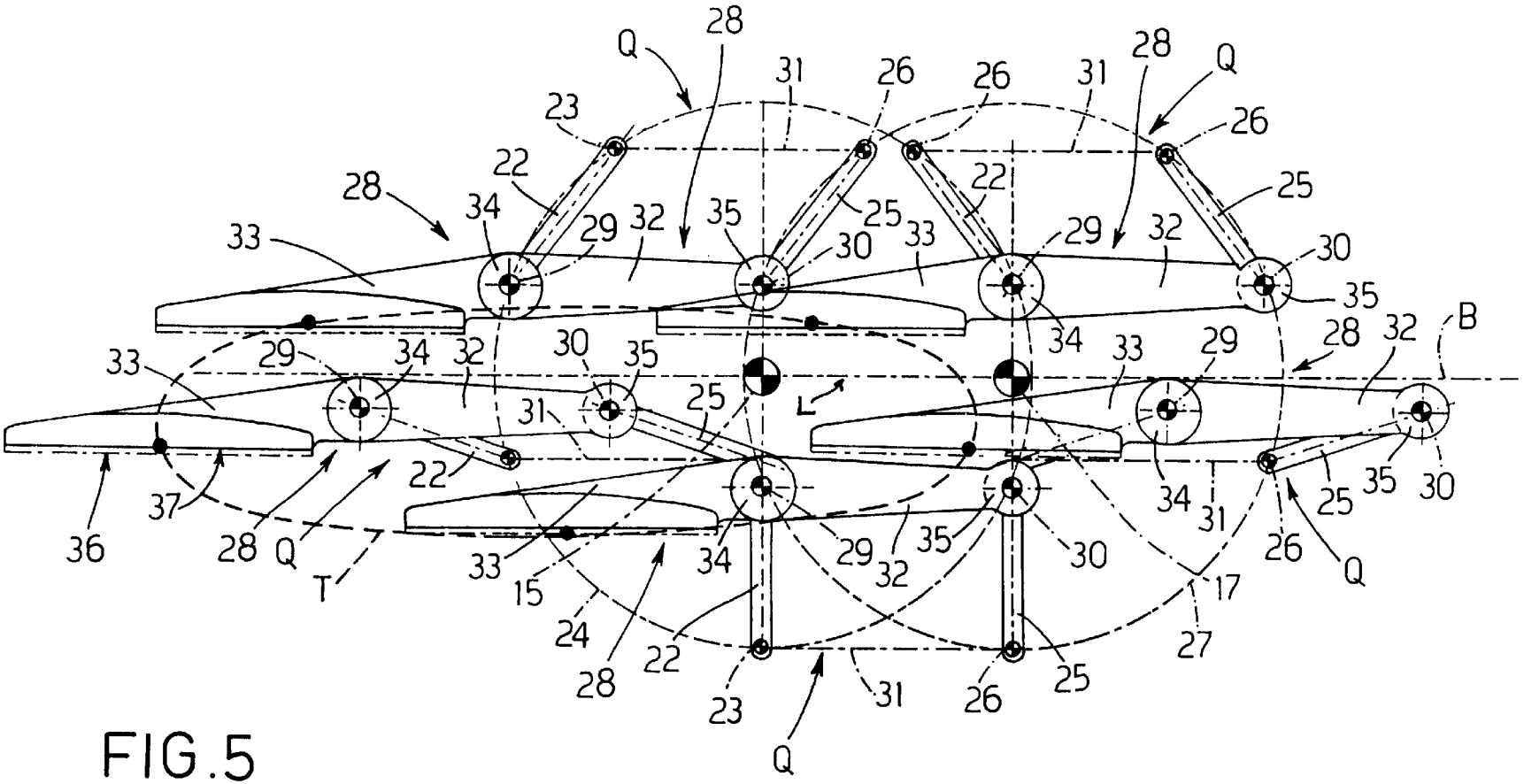
FIG. 5 shows a schematic view of a mechanism of the FIG. 1 device.

Transfer device 4 is located between manufacturing machine 1 and filter-assembly machine 3, and comprises a pickup unit 11 for picking pairs of cigarette portions 2 up off bed 5; and an input supply unit 12 for receiving cigarette portions 2 from unit 11 and feeding cigarette portions 2 to input conveyor 8 in an orderly succession and with a given spacing. Unit 11 is fitted to a beam 13 facing guides 6 of bed 5, and comprises a drum 14 rotating about an axis 15 crosswise to direction D; and a drum 16 rotating about an axis 17. Axes 15 and 17 are parallel and, as shown in FIG. 5, separated by a distance L. Drums 14 and 16 are located on opposite sides of bed 5, with respective axes 15 and 17 in a plane B perpendicular to plane A and facing guides 6, and comprise respective flat circular faces 18 and 19 parallel to each other and to plane A and facing bed 5. Drums 14 and 15 are fitted to respective shafts (not shown) coaxial with axes 15 and 17 and in turn fitted to respective supporting members 20 and 21 extending on opposite sides of beam 13.

With reference to FIG. 5, drum 14 comprises five arms 22 connected in rotary manner to drum 14 so as to rotate, with respect to drum 14, about respective axes 23 parallel to axis 15 and equally spaced about a circumference 24 extending about axis 15. Similarly, drum 16 comprises five arms 25 parallel to respective arms 22 and connected in rotary manner to drum 16 so as to rotate about respective axes 26, which are parallel to axis 17 and equally spaced about a circumference 27 extending about axis 17 and the same size as circumference 24.

Each arm 22, 25 extends from respective face 18, 19 of respective drum 14, 16, and is connected to a corresponding arm 25, 22 by a respective pickup member 28. More specifically, each pickup member 28 is hinged to respective arm 22 at an axis 29, and to respective arm 25 at an axis 30, which is parallel to axes 29 and 15 and separated by distance L from respective axis 29. In other words, each pickup member 28 defines the connecting rod of an articulated quadrilateral Q, of which axes 23, 29, 26, 30 define the hinge axes, arms 22 and 25 define the two cranks, while the frame is a movable frame defined by a line 31 joining axes 23 and 26.

Figure 6:
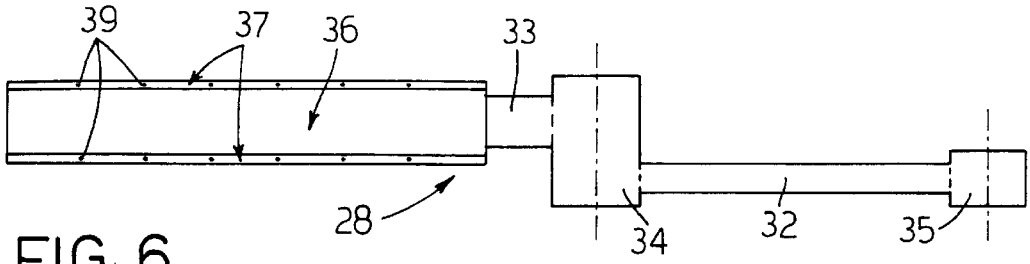
FIG. 6 shows a plan view of a detail in FIG. 1.

With reference to FIG. 6, each pickup member 28 is elongated, and comprises a portion 32 located between axes 29 and 30, and a pickup portion 33. Portion 32 comprises, at opposite ends, two hubs 34 and 35 coaxial with axes 29 and 30; and pickup portion 33 extends from hub 34 and comprises a face 36 parallel to bed 5 and having a pair of seats 37, which are parallel to direction D, are formed along the edges of face 36, and provide for receiving a respective pair of cigarette portions 2. Portions 32 and 33 are offset with respect to each other in a direction perpendicular to the FIG. 5 plane to prevent interference between pickup members 28 as pickup members 28 travel about axes 15 and 17.

A dead conduit 38*a* is formed in each pickup member 28 and communicates with a known suction source (not shown) via a conduit 38*b* extending through arm 22 and drum 14. Conduits 38*a* and 38*b* communicate with each seat 37 via respective channels 39, which are distributed along each seat 37 and generate a vacuum in seat 37 to retain a respective cigarette portion 2.

As drums 14 and 16 are substantially identical, the following description refers solely to drum 14.

Figure 4:
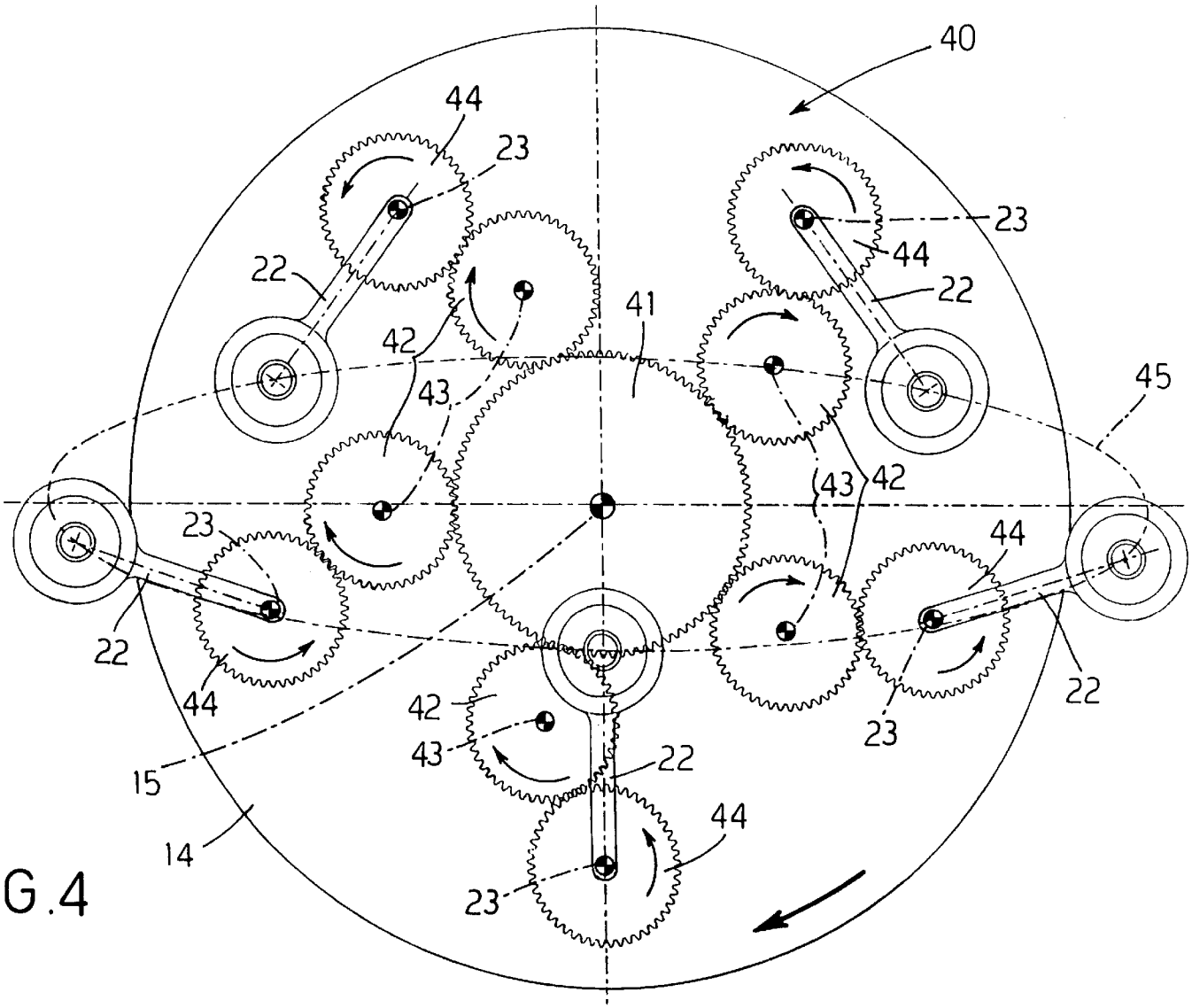
FIG. 4 shows a schematic view of a detail of the FIG. 1 device.

With reference to FIG. 4, drum 14 houses an epicyclic gear transmission 40 for transmitting motion from drum 14 to arms 22. Transmission 40 comprises a fixed sun gear 41 coaxial with axis 15 of drum 14, which acts as a carrier and supports a first series of five planet wheels 42, which are equally spaced about axis 15, mesh with sun gear 41, and rotate about respective axes 43 parallel to axis 15. Drum 14 also supports a second series of five planet wheels 44, each of which meshes with a respective planet wheel 42, rotates about a respective axis 23, and is integral with a respective arm 22. As drum 14 is rotated clockwise in FIG. 4 about axis 15, axes 43 and 23 of planet wheels 42 and 44 are rotated clockwise about axis 15 and fixed sun gear 41, so that planet wheels 42 are rotated clockwise about respective axes 43, planet wheels 44 are rotated anticlockwise about respective axes 23, and axes 29 describe an elliptical path 45 about axis 15.

With reference to FIGS. 1 and 2, supply unit 12 comprises an upright 46 supporting a pair of splined rollers 47 and 48, which are located on opposite sides of plane A and rotate about respective axes 49 and 50 parallel to direction D and lying in plane B. Roller 47 rotates anticlockwise in FIG. 2 about axis 49, and comprises a succession of seats 51 parallel to axis 49 and equally spaced about axis 49 with a spacing P1. Conversely, roller 48 rotates clockwise in FIG. 2 about axis 50, and comprises a succession of seats 52 parallel to axis 50 and equally spaced about axis 50 with a spacing P2 equal to twice spacing P1. Rollers 47 and 48 are separated by a given distance L1 to permit the passage, between rollers 47 and 48, of pickup portion 33 of each pickup member 28, which, as it passes between rollers 47 and 48, releases the pair of cigarette portions 2 into respective seats 51 and 52.

Roller 47 is tangent to conveyor 8, and seats 51 are timed with respect to seats 10 of conveyor 8 to transfer cigarette portions 2 from seats 51 to seats 10.

Unit 12 comprises a splined roller 53, which rotates anticlockwise in FIG. 2 about an axis 54 parallel to direction D, and comprises a number of seats 55 parallel to axis 54 and equally spaced about axis 54 with spacing P2. Roller 53 is tangent to roller 48, and seats 55 are timed with respect to seats 52 of roller 48 to receive cigarette portions 2. Unit 12 also comprises a splined roller 56, which rotates clockwise in FIG. 2 about an axis 57 parallel to direction D, and comprises a number of seats 58 parallel to axis 57 and equally spaced about axis 57 with spacing P2.

As seats 51 are equally spaced with spacing P1, while seats 52 are equally spaced with spacing P2, equal to twice spacing P1, and travel at the same speed as seats 51, the cigarette portions 2 supplied by pickup members 28 occupy all of seats 52 but only alternate seats 51.

Roller 56 is tangent to rollers 53 and 47, and seats 58 are timed with respect to seats 55 of roller 53 to receive cigarette portions 2 from roller 53, and also with respect to the vacant seats 51 of roller 47—i.e. the seats 51 not occupied by cigarette portions 2 supplied directly by pickup members 28—to transfer cigarette portions 2 to roller 47.

In actual use, cigarette portions 2 are fed in pairs in direction D along guides 6 of bed 5 to supply a pair of cigarette portions 2 to pickup station 7.

Drum 14 is rotated clockwise about axis 15 by a motor (not shown), while transmission 40 provides for rotating planet wheels 44 about respective axes 23. That is, arms 22 revolve about axis 15 and feed hubs 34 of respective pickup members 28 along path 45. Member 28 drives arm 25, which in turn rotates drum 16 about axis 17 in time with drum 14. As drum 14 rotates, pickup member 28 is maintained parallel to itself by defining the connecting rod of articulated quadrilateral Q, so that pickup members 28 are fed, parallel to themselves, along path 45 to cyclically feed respective seats 37 along a path T (FIG. 5), which is tangent to pickup station 7, where seats 37 pick up a pair of cigarette portions 2 from guides 6, and is tangent to seats 51 and 52 of respective splined rollers 47 and 48 to transfer cigarette portions 2 into seats 51 and 52 as portion 33 travels between rollers 47 and 48. The cigarette portions 2 transferred into seats 51 of roller 47 are fed directly into seats 10 of input conveyor 8 of filter-assembly machine 3, while the cigarette portions transferred into seats 52 of roller 48 are transferred to roller 53, which in turn transfers the cigarette portions to roller 47 and conveyor 8 through roller 56 as described above.

In a variation not shown, drum 16 differs from drum 14 by not comprising transmission 40, and arms 25 are fitted to drum 16 by shafts (not shown) coaxial with axes 26.

In connection with the above, it should be pointed out that controlling the orientation of each pickup member 28 by means of a respective quadrilateral Q provides not only for generating a control moment on and by which to maintain pickup member 28 perfectly parallel to itself at all times, but also for eliminating the gear transmission invariably provided for this purpose on known transfer devices for controlling said orientation. In other words, connecting two distinct portions of each pickup member 28 to respective actuating members provides not only for preventing oscillation of member 28, but also for greatly simplifying the actuating members themselves.

What is claimed is:

1. A transferring device for transferring cigarette portions between a pickup station, located along a bed of a cigarette manufacturing machine, and at least a first seat of a supply unit for supplying the cigarette portions to an input conveyor of a filter-assembly machine, said first seat being parallel to said bed; the transfer device comprising a pickup member having a second seat for receiving and retaining a cigarette portion and movable along an annular path tangent to the bed and to the supply unit; and guide means connected to the pickup member to move the pickup member along said annular path and control the orientation of the second seat as the second seat travels along said annular path; wherein said guide means comprise a first guide unit and a second guide unit hinged to respective portions of the pickup member separated from each other by a given distance so as to generate a control moment to keep the second seat parallel to said first seat and said bed at any position of said second seat along the annular path; said first guide unit of said pickup member rotating about a first axis; said pickup member being hinged to said first guide unit to rotate, with respect to the first guide unit, about a second axis; said second guide unit rotating about a third axis; said pickup member being hinged to said second guide unit to rotate, with respect to the second guide unit, about a fourth axis; said axes being parallel to one another; and said second and fourth axes being separated by said given distance; said first guide unit comprising a first drum and a respective first arm; said first arm being connected in rotary manner to said first drum so as to rotate, with respect to said first drum, about a fifth axis parallel to the first axis; and said pickup member being hinged to said first arm to rotate, with respect to said first arm, about said second axis; and in that said second guide unit comprises a second drum and a respective second arm; said second arm being connected in rotary manner to said second drum to rotate, with respect to said second drum, about a sixth axis parallel to the first axis; and said pickup member being hinged to said second arm to rotate, with respect to said second arm, about said fourth axis; the first arm being parallel to the second arm; the first and second drum housing respective epicyclic gear transmissions for respectively guiding said second and fourth axes along respective first and second elliptical paths; so as to confer to said annular path an elliptical shape; said pickup member extending crosswise to said first axis, and comprising a first portion connected to the respective first and second arms through said second and fourth axes, and a second portion in which said second seat is formed.

2. A transferring device as claimed in claim 1 and comprising a number of said pickup members having respective said fifth and sixth axes arranged along respective circumferences equal in diameter and centered respectively about the first axis and the third axis.

3. A transferring device as claimed in claim 1, wherein said pickup member comprises two said second seats parallel to each other.

4. A transferring device as claimed in claim 3, wherein said two second seats are side by side.

5. A transferring device as claimed in claim 4, combined with the supply unit for supplying cigarette portions to an input conveyor of a filter assembly machine; wherein the supply unit comprises a first and a second roller; said first and second rollers having respective first seats, each for receiving a respective cigarette portion of a pair of cigarette portions; said annular path protruding in a space between said first and second rollers.

6. The combination transferring device and supply unit as claimed in claim 5, wherein the first and second rollers rotate respectively about a seventh and an eighth axis extending in a direction crosswise to said first axis and lying in a plane defined by said first and third axis.

* * * * *